US006841125B1

(12) United States Patent
Chartier et al.

(10) Patent No.: US 6,841,125 B1
(45) Date of Patent: Jan. 11, 2005

(54) METHOD AND APPARATUS TO CLEAN AND APPLY FOAMED CORROSION INHIBITOR TO FERROUS SURFACES

(75) Inventors: Douglas M. Chartier, Brighton, CO (US); Calvin L. Reid, Commerce City, CO (US)

(73) Assignee: WHI USA, Inc., Brighton, CO (US)

( * ) Notice: Subject to any disclaimer, the term of this patent is extended or adjusted under 35 U.S.C. 154(b) by 77 days.

(21) Appl. No.: 10/342,552

(22) Filed: Jan. 15, 2003

Related U.S. Application Data

(62) Division of application No. 09/957,051, filed on Sep. 20, 2001, now Pat. No. 6,517,617

(60) Provisional application No. 60/289,454, filed on May 8, 2001, and provisional application No. 60/234,004, filed on Sep. 20, 2000.

(51) Int. Cl.[7] ..... C23F 11/08; B08B 9/032

(52) U.S. Cl. ..... 422/7; 134/22.12; 134/22.14; 169/16; 138/DIG. 6

(58) Field of Search ..... 166/312; 134/22.12, 134/22.14, 102.1, 102.2; 169/13, 16; 138/DIG. 6; 208/47; 422/7

(56) References Cited

U.S. PATENT DOCUMENTS

| | | | | |
|---|---|---|---|---|
| 4,197,091 A | | 4/1980 | Gainer | |
| 4,237,975 A | | 12/1980 | Scherubel | |
| 4,436,156 A | | 3/1984 | Fredrickson | |
| 4,807,703 A | | 2/1989 | Jennings, Jr. | |
| 5,046,289 A | | 9/1991 | Bengel et al. | |
| 5,213,120 A | | 5/1993 | Dickson | |
| 5,735,955 A | | 4/1998 | Monaghan et al. | |
| 5,800,629 A | * | 9/1998 | Ludwig et al. | 134/22.11 |
| 5,803,180 A | | 9/1998 | Talley | |
| 6,030,632 A | | 2/2000 | Sawan et al. | |
| 6,042,632 A | | 3/2000 | George | |
| 6,042,750 A | | 3/2000 | Burlew | |
| 6,076,536 A | | 6/2000 | Ludwig et al. | |
| 6,117,558 A | | 9/2000 | Spellane et al. | |
| 6,143,709 A | | 11/2000 | Carey | |
| 6,221,263 B1 | | 4/2001 | Pope et al. | |
| 2002/0060080 A1 | * | 5/2002 | Pliner et al. | 169/16 |

FOREIGN PATENT DOCUMENTS

GB 2185196 A * 7/1987

OTHER PUBLICATIONS

Web site of Solutia Inc. , Sodium Nitrilotriacetate (NTA), 2 pgs, Prior Art.
Web site www.3m.com, 3M Floorad Well Stimulation Additive FC–751, 2 pgs, Prior Art.

(List continued on next page.)

*Primary Examiner*—Elizabeth McKane
(74) *Attorney, Agent, or Firm*—Margaret Polson; Patent Law Offices of Rick Martin, P.C.

(57) ABSTRACT

The present invention relates to the application of a coating to a pipeline, FPS (Fire Protection System) or to pipe stock from which a pipeline is fabricated. A composition which when applied to the inside surface of the pipe prevents either chemical corrosion or microbiologically influenced corrosion is disclosed. Also disclosed is a method for utilizing this material to protect both existing pipelines and the raw stock used to construct pipelines and various apparatus for applying a coating of the composition, cleaning, and maintenance of the passive coating. Also disclosed is a method to recycle the composition to be used in other industrial pacification processes. The composition, methods, and apparatus are environmentally friendly and eliminate the need to use poisonous, environmentally damaging biocides currently used in the prevention of microbiologically influenced corrosion (MIC) in FPS, water treatment, nuclear, petroleum and natural gas transportation pipelines, and various processing equipment within industry.

1 Claim, 4 Drawing Sheets

OTHER PUBLICATIONS

Clearwater, Inc., Engineered Chemistry, technical data, CAT–Foam—Cationic Foaming Agent, 1 pg, Mar. 1999.
Clearwater, Inc., Engineered Chemistry, technical data, Amphoam 75, 1 pg, Aug. 1999.
Clearwater, Inc., Engineered Chemistry, technical data, Amphoam, 1 pg, Nov. 2000.
Tetraco Concentrates.htm, Tetraco Concentrates Quat Amine Source, Concentrates, 3 pgs, Prior Art.
Tetraco Intermediate.htm, Tetraco Intermediate Quat Amne Source, Intermediates, 3 pgs, Prior Art.
Tetraco Miscellaneous Products.htm, Tetraco Miscellaneous Products Quat Amines, Miscellaneous Products, 2 pgs, Prior Art.
Tetraco Special Products.htm, Tetraco Special Products Quat Amine Source, Special Products, 3 pgs, Prior Art.
Witco Asia Pacific Pte Ltd.htm, Witco Asia Pacific Pte Lte Quat Amine Source, 2 pgs, Prior Art.
FeF Chemicals A/S, Quaternary Ammonium Compounds, 3 pgs, Prior Art.
ASTM Designation: D 5806–95, Standard Test Method for Disinfectant Quaternary Ammonium Salts by Potentiometric Titration, 4 pg, Prior Art.
Polyvinylpyrrolidone, 1 pg, Prior Art.
Chem–Add Enterprises Ltd., Methods of Preventing Scale Formation, 4 pg, Prior Art.
Sodium Silicate, 2 pgs, Prior Art.
Applied Hydro Technologies, Inc., Sodium Nitrite, 2 pgs, Prior Art.
Nalco Chemical Company, Corrosion Inhibitor, 39–MN, 39–L—Inhibitor, Corrosion, Liquid, Material Safety Data Sheet, 5 pgs, Prior Art.
Bartleby.com, The Columbia Encyclopedia, sixth edition, 2001, Borax, 2 pgs.
CP Chem web page, Sodium Alkane Sulfonate, 2 pgs, Prior Art.
PMP Fermentation Products, Inc., Gluconate Products, 2 pgs, Prior Art.
Molybdenum Disulfide, 6 pgs, Prior Art.
Techao Group of Comapnies, web page, chemical and intermediates manufacturer . . . cturer, industrial chemicals from India, 2 pgs, Prior Art.
Product Information Summary, Stimulation/Production Chemicals, Oxygen Scavengers, 2 pgs, Prior Art.
Product Information Summary, Stimulation/Production Chemcials, Acids and Acid Systems, 4 pg.s, Prior Art.
Alken DRSD 886, Material Safety Data Sheet, Dry Inhibited Sulfamic Acid Cleaner for all Water Systems, 2 pgs, Prior Art.
Wheel Test 500 ppm H2S.htm, API Wheel Test, 3 pgs, Prior Art.
Journal of the American Ceramic Society (USA), vol. 81, No. 11, pp 3029–3031, Nov. 1998, Hydroxyapatite coating on a collagen membrane by a blomimetic method, Rhee, S–H; Tanaka, J.

* cited by examiner

METHOD AND APPARATUS TO CLEAN AND APPLY FOAMED CORROSION INHIBITOR TO FERROUS SURFACES

CROSS REFERENCE APPLICATIONS

This application is a divisional application of utility patent application Ser. No. 09/957,051 filed Sep. 20, 2001 which issued as U.S. Pat. No. 6,517,617 on Feb. 11, 2003, and claiming benefits of provisional application Ser. No. 60/234,004 filed Sep. 20, 2000 and provisional application No. 60/289,454 filed May 08, 2001.

FIELD OF INVENTION

The present invention relates to cleaning and applying an environmentally friendly corrosion inhibitor to the interior surface of fire protection systems, industrial piping and pipelines utilizing foam and devices for creating and applying the foams.

BACKGROUND OF INVENTION

Piping systems, particularly those carrying crude oil, oil products, and natural gas are subject to chemical corrosion (primarily due to carbon dioxide and hydrogen sulfide) and to corrosion caused by microbial growth in the piping systems, so called MIC (microbiologically influenced corrosion). MIC is caused by both anaerobic and aerobic bacteria and therefore can occur in both aerobic and anaerobic systems and systems which have a mix of conditions. It has been found that MIC also occurs in fire protection sprinkler pipeline systems. The interior environment of FPS (fire protection systems) have similar mixed anaerobic/aerobic conditions as oil transmission pipelines and are equally prone to the growth of microorganisms. In addition, water often stands stagnant for long periods in these FPS, and acts as a breeding ground for the very microorganisms that cause the MIC.

One method of dealing with microorganisms and corrosion of a fire protection piping system has been detailed in U.S. Pat. No. 6,076,536 to Ludwig et. al. Ludwig discloses the introduction of an anti-microbial agent into the water residing in the system after the system has been chemically cleaned in a previous step and passivated in a second step. This multi-step cleaning/passivation procedure requires isolation and opening the system, and the anti-microbial treatment presents the possibility of exposing humans to potentially harmful levels of the anti-microbial agent in the event the system is activated or opened for servicing.

Another method is disclosed in U.S. Pat. No. 5,803,180 to Talley. In this method, the stagnant water is treated to have a high pH, which retards microbial growth. This method also involves multi-step preparation of the pipeline and requires extensive procedures to electrically isolate ferrous members and nonferrous members of the piping system to prevent galvanic corrosion, which would otherwise occur in the presence of the residual basic fluid. This also presents the possibility of exposing humans to the caustic fluid if the system is activated or opened for servicing.

Another method of microorganism control within fire protection systems is detailed in U.S. Pat. No. 6,221,263 to Pope, et. al. This involves a device and method for automatically treating water as it enters a fire protection sprinkler system (FPS) to kill microbes introduced with the water. This device and method, again, introduce an antimicrobial treatment, which, again presents the possibility of exposing humans to potentially harmful levels of the anti-microbial agent in the event the system is activated or opened for servicing.

Another typical prior art method of cleaning pipelines such as those used in oil transmission involve forcing a "pig" through the line to remove sludge clinging to the walls. However, in some sections of pipeline, no facilities for "pigging" the line have been installed or cannot be installed. Other prior art methods involve chemical cleaning of the line, but this requires shutting down a section of line for such treatment.

Still other chemical treatments for both cleaning and corrosion protection have been injected into the fluid transmitted through the pipeline. Such a system is disclosed in U.S. Pat. No. 6,042,632. In such systems, the anticorrosive material is continuously added to the fluid to be transported through the pipeline. The system works well when the fluid is first placed in a storage tank and then put into the pipeline. The anticorrosive material is easily added to the fluid in the storage tank before the fluid is placed in the pipeline. If the fluids are not first placed a storage tank prior to being transported through the pipeline, then expensive high pressure pumping equipment is required to introduce the anticorrosive material into the pipeline while the fluid is transported.

Several classes of chemical agents have been used as anticorrosive agents in pipelines. Some of the chemical agents are known to produce coatings that have antimicrobial properties. An example of an anti-microbial coating is disclosed in U.S. Pat. No. 6,030,632 to Sawan et. al. Anticorrosive agents which have been applied to pipelines have been disclosed in U.S. Pat. No. 6,117,558 to Spellane et. al, U.S. Pat. No. 6,042,750 to Burlew, and U.S. Pat. No. 4,197,091 to Gainer. These patents are directed to the application of coatings or polymeric coatings which contain or are the reaction product of aldehydes, amines, carboxylic acids (both mono and poly functional), pyridines, imidazols, anilines, fatty acids both saturated and unsaturated, diamines, and aliphatic quaternary ammonium salts.

Other methods of treating pipelines have been detailed in U.S. Pat. No. 5,046,289 to Bengel et. al, U.S. Pat. No. 5,735,955 to Monaghan et. al, and U.S. Pat. No. 5,213,120 to Dickson. In the '289 patent, a mechanical head which ablates the surface of the pipe is passed down through the pipe. This is impractical for long lengths of pipe such as an oil transmission line, and costly for a closed system such as a fire protection system. Both the '120 and '955 patents utilize a dispersion head passed down the pipeline, which generates foam containing the substance used to treat the pipeline. Contact of the foam with the interior surface of the pipeline disperses the treatment agent on the interior of the pipeline surface.

While the use of a mechanical head to disperse foam within a pipeline has the same shortcomings as the use of a mechanical cleaning head, the use of foam to carry the treating agent down of a pipeline and bringing the treating agent against all the interior surfaces is something that can be practiced with minimal support equipment and no particular line fittings. The present invention makes use of this principle to disperse agents to clean and treat the interior of a pipeline or fire protection system.

The present invention discloses foamed compositions which when applied to the inside surface of a pipe helps reduce or prevent chemical corrosion or microbiologically influenced corrosion of the pipe surface. The present invention also discloses methods and apparatus for cleaning and applying this composition to the interior surface of existing fire protection systems and pipelines. The composition can also be applied to the raw pipe stock used to construct fire protection systems and pipeline.

SUMMARY OF INVENTION

One aspect of the invention is to clean, passivate, and apply an anti-microbial coating and corrosion inhibitor within the internal fire sprinkler systems, pipelines, and other piping walls with a non-residue foam of environmentally friendly composition in a single step application.

Another aspect of the invention is an apparatus to create said foam and release it into the system being cleaned in high-energy pulses, which aids in the cleaning and transportation of fines and biomass particulates and the installation of an anti-microbial barrier.

Another aspect of the invention is a method for recycling, reconstituting, and conditioning effluent from the cleaning, passavating process to be used again in other corrosion inhibition processes and applications. Thus reducing disposal problems and potential harm to the environment and waterways.

Still another aspect of the invention is to create a microbial barrier on the inner walls of fire protection systems reducing the likelyhood of sprinkler head or other valve fouling by-products iron sulfides, oxides, etc, and biomass remnants and tubercles formation.

Still another aspect of the present invention is that in some embodiments the compositions can be sprayed, dipped, or otherwise contacted with a metal surface to apply an anticorrosive, anti-microbial coating.

Other aspects of this invention will appear from the following description and appended claims, reference being made to the accompanying drawings forming a part of this specification wherein like reference characters designate corresponding parts in the several views.

The present invention discloses a range compositions which can be applied to metal surfaces, particularly ferrous metal surfaces, to clean the surface and coat the surface with an anti-microbial, anti-corrosion layer. The compositions can be turned into high-density foam to use the viscosity of the foams to dislodge and remove existing corrosion and then apply the desired coating to the surface.

Several devices are disclosed to create the foam and apply the foam to pipelines, fire protection systems and other industrial pipeline.

One device to clean fire protection systems has a tank with an air sparger mounted in it. Corrosion inhibitor is pumped into the tank and then foam is formed by pumping compressed air through the air sparger. Foam with a quality between 50Q and 95Q (50% to 95% air, by volume) and a half-life of at least one hour is created and then released into the piping system to be treated. The foam can be continuously fed through the system or pulsed to dislodge adhered particles. Once the foam exiting the system is clear, showing all debris have been removed, the foam is flowed through the system for three times the length of the cleaning stage to allow the corrosion inhibitor to fully coat the inside of the piping. The system is then blown dry using compressed air.

This process may be accomplished in one step. Minimum fluid may be used to accomplish fluid contact within the internal walls of fire sprinkler pipe, industrial piping and pipelines. This is especially important within the fire protection industry where a thick coat of inhibitor is not desired, as it may interfere with the systems valving or sprinkler activation during a fire.

Figure 1:
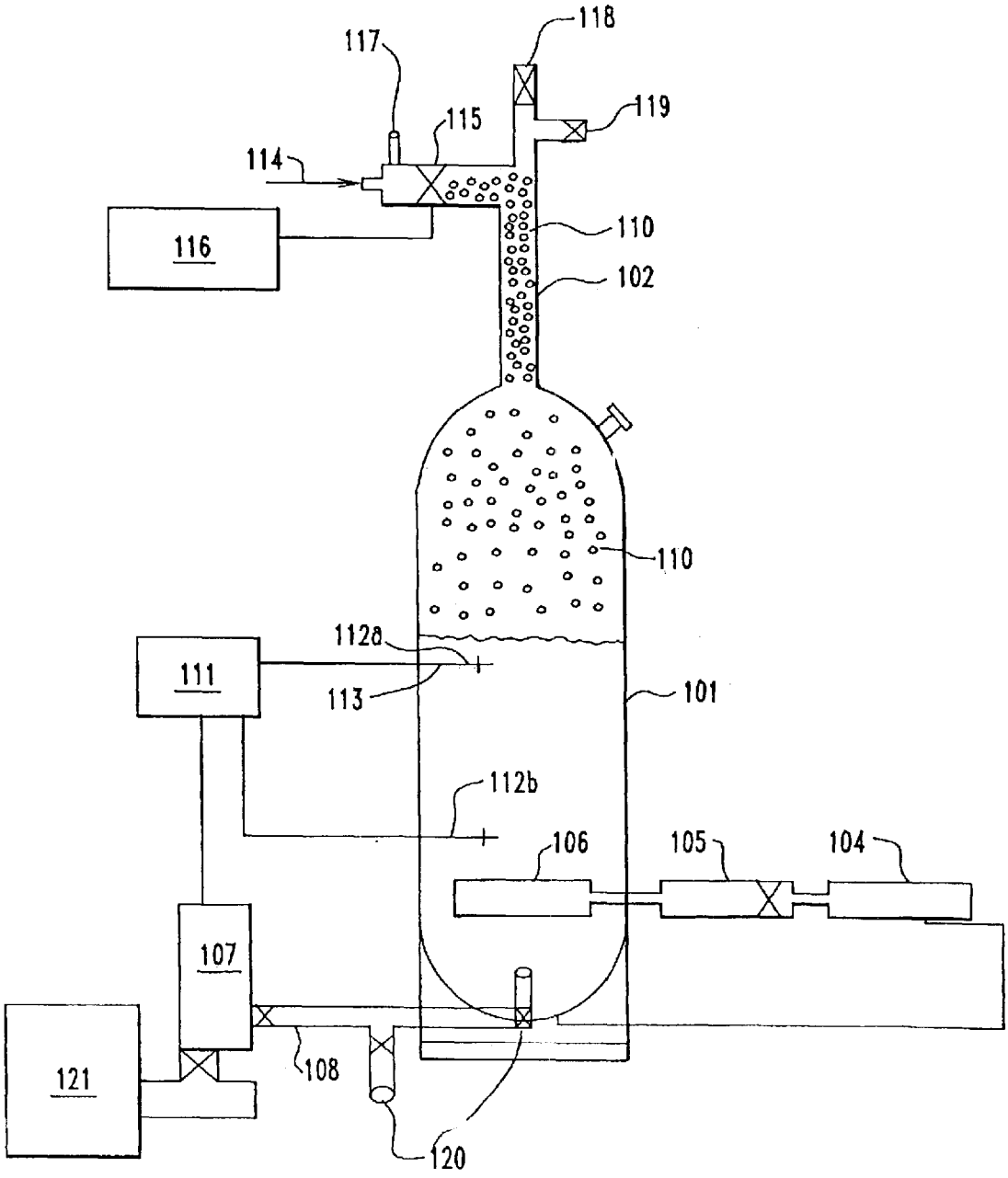
FIG. 1 is a cut away view of the foam generating apparatus.

Before explaining the disclosed embodiments of the present invention in detail, it is to be understood that the invention is not limited in its application to the details of the particular arrangement shown, since the invention is capable of other embodiments. In addition, the terminology used herein is for the purpose of description and not of limitation.

DETAILED DISCLOSURE OF THE INVENTION

Mechanism of Passification

The surface of ferrous metals is known to have a natural passivation layer of oxygen molecules from the atmosphere upon the exposed metal. This layer of passivation is complete among stainless steels and gives them their non-corrosive properties. Oxygen combines with the chromate molecules, within the stainless steel, and forms a barrier that is impermeable for chemical corrosion. Aluminum also forms such a natural passive layer with oxygen available from the atmosphere. Even though this mechanism is very efficient against chemical corrosion, it does not protect against microbes attaching and causing biological corrosion to occur.

Ferrous metals form this natural passive layer with atmospheric oxygen, but it is not as complete as with stainless steel and aluminum. The chemical and biological corrosive process penetrates this layer with ease.

The oxide layer has a negative or anionic charge. This layer has a natural affinity for cationic quaternary amines (which have a positive-or cationic charge) within the corrosion inhibitor formulation. The formulation is introduced into the system to be passified, within an aqueous system. This medium allows for easy transfer of ions. The quaternary amines and other chemicals form a tight ionic chemical bond. This provides a layer of passivation and bio-static coating, which is a barrier against chemical and biological penetration. In addition, the quaternary amines lower the surface tension of the aqueous phase and disrupt the natural osmotic pressure between bacteria cell walls and medium, affecting nutrient and waste transfer of the biological process, killing the bacteria.

The primary coating of cationic quaternary amines upon the oxide film that covers the internal piping surface may be disrupted by normal operation conditions of fire protection systems and pipeline. System operation, system testing, velocity of fluids and particulate abrasion may dislodge the in place coating. Disruptions in the layer of passivity create an ionic imbalance on the surface of the coating. Exposure of the oxide layer is created and the voids between the oxygen molecules create a pathway for MIC and chemical corrosion to occur on the internal piping wall. Therefore, a maintenance system must be in place to insure the integrity of the internal pipe wall is not violated. The chemical formulations used in the primary application may be used for the maintenance procedure as well.

Composition of the Coating Material

It has long been known the disinfectant and biostatic nature of quaternary amine compounds. They are commonly used in products such as Bactine, Lysol, and even have diverse properties, which make them useful as static charge dissipaters and fabric softeners. In addition, quaternary amines are known to have good surface agent activity and to be useful for the cleaning of metal surfaces. The public has contact with these quaternary amine compounds in their daily lives and there has been no adverse to the environment in small quantities. Quaternary amine salts are known to form a highly durable coating which is very difficult to remove from metallic surfaces. Imidazole and imidazoline derivatives are also known to create a highly durable coating which remains effective at higher temperatures (150 F to 300 F) such as are encountered in oilfield processing and transportation of product. Alkyl pyridine quaternary ammonium chloride has good heat stability and creates a highly durable film. All are cationic surfactants, which clean and create stable foam for inhibitor transport and applying to internal piping walls.

General Formula:

X: 10 to 20% by weight, X is chosen from among:

X1: Benzylcoco alkyldimethyl quaternary amine C8-C18 (preferred product: DMCB 80 from AKZO, Chicago, Ill.)

Or:

X2: C12 alkyl trimethyl ammonium chloride (preferred product: Tetra 12, Tetraco, Midland, Tex.)

Or:

X3: Di-C10 dimethyl ammonium chloride [preferred product: D121(C1), Shanghai Jingwei Chemical, Singapore.]

Y: 10 to 20% by weight, y is chosen from among:

Y1: Oleic imidazoline (preferred product: Ablumine-o, Taiwan Surfactant, Taiwan.)

Or:

Y2: Imidazole, imidazoline derivatives, quaternary amine (C8-C18) C1 salt blend (preferred product: Tetra 16, Tetraco, Midland Tex.)

OR:

Y2: Imidazoline derivatives blend (preferred product: Hydro Amine, B-D Chemical, Denver, Colo.)

Z: 10 to 15% by weight

Z1: Quaternized alkyl pyridine (preferred product: Tetra 600, Tetraco, Midland, Tex.)

OR:

Z2: Quaternized alkyl pyridine (preferred product: Tetra 600, Tetraco, Midland, Tex.)

W: 10 to 20% by weight

Isotridecyloxpropyldihydroxyethylmethyl ammonium chloride (preferred product: Tomah Q-17-2-PG, Van Waters & Rogers, Denver, Colo.)

A: 1% by weight Ammonium Chloride electrolyte.

B: Sodium Bicarbonate, or equivalent food grade buffer, as needed for pH adjustment: Neutralize to pH of 6.7 to 7.5 with approximately 1 pound per gallon sodium bicarbonate (or equivalent) (B) solution, where acidic conditions may not be desirable.

0 to 10% by weight specific additives as needed:

C: Tetrakis (Hydroxymethyl) Phosphonium Sulfate, technical grade preferred (Additive for increased bio-static activity of coating)

D: Citric Acid, food grade preferred (Additive for chelating of dissolved iron, calcium, and magnesium)

E: Sulfamic Acid, food grade preferred (Additive for dissolving scale & tubercles)

F: Sodium EDTA, food grade preferred (Di, Tri, and Tetra sodium salts of ethylendediaminetetraacetic acid) (Additive for chelating of dissolved iron, calcium and magnesium)

G: Acetic Acid, technical grade preferred (Additive for dissolving scale & tubercles)

H: Molybdenum Disulfide, technical grade preferred (Additive to make layer of passivity more tenacious in high velocity, often used systems)

I: Sodium Thiosulfate, technical grade preferred (Oxygen scavenger used in systems where aeration of aqueous system exists in the process)

J: Sodium Gluconate, food grade preferred (Additive used as chelating agent and sequestering in high temperature (<200 F) situations).

K: Sodium Dodecylbenzenesulfonate, technical grade preferred (Surfactant used to disperse other additives within the formulation)

L: Sodium Metaphosphates, technical grade preferred (Additive used as a scale inhibitor and sequesterant in systems where hard water is present)

M: Sodium Phosphates, technical grade preferred (mono and dibasic) (Additive used as a scale inhibitor and sequesterant where hard water is present)

N: Sodium Alkane Sulfonate, technical grade preferred (Surfactant used to disperse other additives within the formulation)

O: Sodium Borate & Sodium Nitrite, technical grade preferred (Additives to make layer of passivity more tenacious in high velocity, often used systems)

P: Sodium Metasilicate, technical grade preferred (Additive used to make layer of passivity more tenacious in high velocity, often used systems)

Q: Sodium-N-methyl-oleoyltaurate, technical grade preferred (Surfactant used to disperse other additives within the formulation)

R: Sodium Orthophosphates, technical grade preferred (Additive used to chelate dissolved iron, calcium, and magnesium)

S: Sodium Orthosilicate, technical grade preferred (Additive used to make layer of passivity more tenacious in high temperature (<200 F) high velocity, often used systems)

T: Phosphate Esters, technical grade preferred (Additive used as a scale inhibitor and scale crystal distorter where hard water is present)

U: Sodium NTA, food grade preferred (Additive used as a chelating & sequestering agent where hard water is present)

V: Polyvinylpyrrolidone, technical grade preferred (Additive used for increased bio-static activity of coating)

Ab: Catfoam (Cationic Foamer) (Clearwater, Pittsburgh, Pa.)

Other additives known in the art may also be added. Additives may be added, each with 0 to 10% by weight of total formulation weight. It is preferred to use food grade chemicals as the additives as this makes it easier to insure that the compositions will more easily meet any relevant water quality or other standards. While the discussion has been in terms of specific additives, it is to be understood that groups of additives will work as well. Reactant concentration and any foam stabilizers should be increased as the amount of corrosion increases and as a function of pressure used.

Most Preferred Formulation for FPS and Pipelines

Foams comprising 90–95 vol. % air, 1.3 to 1.5 vol. % water and 3.5 to 8.7 vol. % of a composition adherent to ferrous surface on contact containing about 18.0 to about 20.0 wt. % X1, about 18.0 to about 20.0 wt. % Y2, about 14.0- to about 15.0 wt % Z1, about 18 to 20 wt. % W, about 8.0 to 12 wt. % B, 0.5% to 1.0 wt. % A, 1.0 to 5.0 wt. % U, 1.0 to 3.0% T, 0.5 to 1.0% K, 2.0 to 3.0 wt. % C.

More Preferred Formulation for FPS and Pipelines

Foams comprising 90–95 vol. % air, 1.3 to 1.5 vol. % water and 3.5 to 8.7 vol. % of a composition adherent to ferrous surface on contact containing about 18.0 to about 20.0 wt. % X1, about 18.0 to about 20.0 wt. % Y2, about 14.0 to about 15.0 wt % Z1, about 18 to 20 wt. % W, about 8.0 to 12 wt. % B, 0.5% to 1.0 wt. % A, 1.0 to 5.0 wt. % T, 1.0 to 3.0% F, 0.5 to 1.0% K, 2.0 to 3.0 wt. % C.

Preferred Formulation for FPS and Pipelines

Foams comprising 90–95 vol. % air, 1.3 to 1.5 vol. % water and 3.5 to 8.7 vol. % of a composition adherent to ferrous surface on contact containing about 18.0 to about 20.0 wt. % X2, about 18.0 to about 20.0 wt. % Y2, about 14.0 to about 15.0 wt % Z1, about 18 to 20 wt. % W, about 8.0 to 12 wt. % B, 0.5% to 1.0 wt. % A, 1.0 to 5.0 wt. % T, 1.0 to 3.0% F, 0.5 to 1.0% K, 2.0 to 3.0 wt. % C.

Most Preferred Formulation Anaerobic Bacteria in PPS and Pipelines

Foams comprising 90–95 vol. % air, 1.3 to 1.5 vol. % water and 3.5 to 8.7 vol. % of a composition adherent to ferrous surface on contact containing about 18.0 to about 20.0 wt. % X1, about 18.0 to about 20.0 wt. % Y2, about 14.0- to about 15.0 wt % Z1, about 18 to 20 wt. % W, about 8.0 to 12 wt. % B, 0.5% to 1.0 wt. % A, 1.0 to 6.5 wt. % V, 0.5 to 1.0% K, 2.0 to 4.5 wt. % C.

Most Preferred Formulation Aerobic Bacteria in FPS and Pipelines

Foams comprising 90–95 vol. % air, 1.3 to 1.5 vol. % water and 3.5 to 8.7 vol. % of a composition adherent to ferrous surface on contact containing about 18.0 to about 20.0 wt. % X1, about 18.0 to about 20.0 wt. % Y2, about 14.0- to about 15.0 wt % Z1, about 18 to 20 wt. % W, about 8.0 to 12 wt. % B, 0.5% to 1.0 wt. % A, 1.0 to 5.0 wt. % I, 1.0 to 3.0% V, 0.5 to 1.0% K, 2.0 to 3.0 wt. % C.

Most Preferred Formulation Aerobic/Anaerobic Bacteria in FPS and Pipelines

Foams comprising 90–95 vol. % air, 1.3 to 1.5 vol. % water and 3.5 to 8.7 vol. % of a composition adherent to ferrous surface on contact containing about 18.0 to about 20.0 wt. % X1, about 18.0 to about 20.0 wt. % Y2, about 14.0- to about 15.0 wt % Z1, about 18 to 20 wt. % W, about 8.0 to 12 wt. % B, 0.5% to 1.0 wt. % A, 1.0 to 5.0 wt. % I, 1.0 to 3.0% V, 0.5 to 1.0% K, 2.0 to 3.0 wt. % C.

Most Preferred Formulation High Temperature (<200 F) for Pipelines

Foams comprising 90–95 vol. % air, 1.3 to 1.5 vol. % water and 3.5 to 8.7 vol. % of a composition adherent to ferrous surface on contact containing about 18.0 to about 20.0 wt. % X1, about 18.0 to about 20.0 wt. % Y2, about 14.0 to about 15.0 wt % Z1, about 18 to 20 wt. % W, about 8.0 to 12 wt. % B, 0.5% to 1.0 wt. % A, 1.0 to 5.0 wt. % I, 1.0 to 3.0% S, 0.5 to 1.0% K, 2.0 to 3.0 wt. % J.

Most Preferred Formulation High Velocity Systems for FPS and Pipelines

Foams comprising 90–95 vol. % air, 1.3 to 1.5 vol. % water and 3.5 to 8.7 vol. % of a composition adherent to ferrous surface on contact containing about 18.0 to about 20.0 wt. % X1, about 18.0 to about 20.0 wt. % Y2, about 14.0 to about 15.0 wt % Z1, about 18 to 20 wt. % W, about 8.0 to 12 wt. % B, 0.5% to 1.0 wt. % A, 1.0 to 5.0 wt. % H, 1.0 to 3.0% O, 0.5 to 1.0% K, 2.0 to 3.0 wt. % P.

Most Preferred Formulation High Temperature, High Velocity Systems for FPS and Pipelines Foams comprising 90–95 vol. % air, 1.3 to 1.5 vol. % water and 3.5 to 8.7 vol. % of a composition adherent to ferrous surface on contact containing about 18.0 to about 20.0 wt. % X1, about 18.0 to about 20.0 wt. % Y2, about 14.0 to about 15.0 wt % Z1, about 18 to 20 wt. % W, about 8.0 to 12 wt. % B, 0.5% to 1.0 wt. % A, 1.0 to 5.0 wt. % I, 1.0 to 3.0% H, 0.5 to 1.0% K, 2.0 to 3.0 wt. % J.

Most Preferred Formulation High Scale Potential (Hard Water) Systems for FPS and Pipelines Foams comprising 90–95 vol. % air, 1.3 to 1.5 vol. % water and 3.5 to 8.7 vol. % of a composition adherent to ferrous surface on contact containing about 18.0 to about 20.0 wt. % X1, about 18.0 to about 20.0 wt. % Y2, about 14.0 to about 15.0 wt % Z1, about 18 to 20 wt. % W, about 8.0 to 12 wt. % B, 0.5% to 1.0 wt. % A, 1.0 to 5.0 wt. % U, 1.0 to 3.0% R, 0.5 to 1.0% K, 2.0 to 3.0 wt. % F.

Most Preferred Formulation High Scale Potential, High Temperature (<200 F) Systems for Pipelines Foams comprising 90–95 vol. % air, 1.3 to 1.5 vol. % water and 3.5 to 8.7 vol. % of a composition adherent to ferrous surface on contact containing about 18.0 to about 20.0 wt. % X1, about 18.0 to about 20.0 wt. % Y2, about 14.0 to about 15.0 wt % Z1, about 18 to 20 wt. % W, about 8.0 to 12 wt. % B, 0.5% to 1.0 wt. % A, 1.0 to 5.0 wt. % U, 1.0 to 3.0% F, 0.5 to 1.0% N, 2.0 to 3.0 wt. % I.

Most Preferred Formulation High Tuberculation, Scale Formulation for FPS and Pipelines Foams comprising 90–95 vol. % air, 1.3 to 1.5 vol. % water and 3.5 to 8.7 vol. % of a composition adherent to ferrous surface on contact containing about 18.0 to about 19.0 wt. % X1, about 18.0 to about 20.0 wt. % Y2, about 11.0 to about 13.0 wt % Z1, about 10 to 13 wt. % W, about 2.0 to 4.0 wt. % U, 0.5% to 1.0 wt. % A, 5.0 to 10.0 wt. % E, 5.0 to 10.0 wt. % D, 8.0 to 10.0 wt. % Ab.

Exemplary Procedure:

Start with 25 to 60% water base.

Add DMCB 80 (X1) (or equivalent) slowly with backpressure on Sandpiper or equivalent pump circulating mixture as it is meshed and dispersed. Mix to homogeneous mixture.

Add quaternized alkyl pyridine (Z1) (slowly with backpressure on Sandpiper or equivalent pump circulating mixture as it is meshed and dispersed. Mix to homogeneous mixture.

Circulate for 30 minutes

Add Oleic Imidazoline (Y1) very slowly with ¼ addition flow allowed through pump while circulating product. Mix to homogeneous solution.

Add Tomah Q-17-2-PG (W) (or equivalent) until fully homogenized.

Add 1% (by weight of total batch) (A) ammonium chloride. Circulate for 1 hour. Additives may be added 0 to 10% by weight.

Neutralize to pH of 6.7 to 7.5 with approximately 1 pound per gallon sodium bicarbonate (B) solution, where acidic conditions may not be desirable.

Circulate for 30 minutes.

The foam can be formed by using compressed air, $CO_2$, natural gas or nitrogen gas, depending on the formulation used and the application.

The foaming ability of solution is tested using the American Petroleum Institute method "API 46" "Testing Foam Agents for Mist Drilling" with 50Q, 75Q & 95Q foam to assure that the half life of foam is at least one hour. All formulations preferably should be engineered with a one-hour half-life of foam as a standard. Actual field-testing should then be performed, using the foam generating pparatus, to ensure that the foam can be produced commercially with a half-life of at least one hour.

It will be obvious to one skilled in the chemical arts that many variations of the composition containing quaternary amines, imides, and imidazoles and imidazoles derivatives will be equally useful to this end.

EXAMPLES

Example 1

T&A Produce, Inc. of California has a fire sprinkler system in their bag storage plant in Salinas, Calif. A site inspection has revealed that heavy tuberculation, from MIC activity, exists within the system. The heavy tuberculation must be removed in order for the passivation of the internal wall of the fire sprinkler piping to be effective. Laboratory testing is done on a sample of the piping and it is determined that the following formulation will be effective at cleaning & passifying this particular fire protection system:

The most preferred formulation for FPS and pipelines listed above with the addition of the following additives:

- 1.0% (by weight) Sodium Dodecylbenzenesulfonate (K) (Surfactant used to disperse other additives within the formulation).
- 10.0% (by weight) Sulfamic Acid (E) (Additive used to dissolve tubercles from the inside piping walls).
- Formulation should not be neutralized to pH of 6.7 to 7.5. The pH of solution needs to be below 1.0.

Example 2

Duke Energy Field Services of Colorado has a natural gas pipeline, which is 6 miles in length, 6" diameter in Platteville, Colo. Gas analysis shows there is a level of hydrogen sulfide gas of 324 ppm. Analysis also detects a population of MIC causing bacteria (SRB) sulfate reducing bacteria) at levels above (>) 1,000,000 colonies/cc. The velocity of the pipeline's gas exceeds a constant of 100 SCF/minute 24 hours a day. Laboratory testing is done on a section of the pipeline with gas samples (from the actual pipeline) re-circulated at 10 scf /minute STP for a period of 7 days, using various formulations. It is determined that the following formulation will be effective in forming a tenacious bio-static coating, under these specific conditions:

The most preferred formulation for FPS and pipelines listed above with the addition of the following additives:

- 3.5% (by weight) Sodium Borate (O) (Additive to make layer of passivity more tenacious in high velocity, often used systems).
- 5.0% (by weight) Polyvinylpyrrolidone (V) (Additive to increase bio-static coating properties).

Example 3

Dole of California has a plant in Tempte, Ariz. where vegetable processing and packaging is performed. Water from a cooling tower is used to cool the water received from heat exchangers, within the plant. Analysis of the water from the cooling tower indicates a high level of MIC causing bacteria: APB (acid producing bacteria) and SLYM (slime producing bacteria). In addition, high levels of calcium (311 ppm) and magnesium (123 ppm) have been detected by chemical analysis. Laboratory testing of various formulations determines that the following formulation will be effective in assuring scale deposition will not occur and a tenacious bio-static coating will be applied:

The most preferred formulation for FPS and pipelines listed above with the addition of the following additives:

- 5.0% (by weight) Polyvinylpyrrolidone (V) (Additive to increase bio-static coating properties).
- 1.0% (by weight) Sodium Alkane Sulfonate (N) (Surfactant used to disperse other additives within the formulation)
- 7.4% (by weight) Citric Acid (D) (Additive for chelating of dissolved iron, calcium, and magnesium)
- 2.8% (by weight) Sodium NTA (U) (Additive used as a chelating & sequestering agent where hard water is present)
- 4.0% (by weight) Sodium Thiosulfate (I) (Oxygen scavenger used in systems where aeration of aqueous system exist in the process).

Formulation should be neutralized to a pH range of 5.0 to 4.5 with sodium bicarbonate (B).

DETAILED DESCRIPTION OF THE DRAWINGS

One of the novel uses for the corrosion inhibitor disclosed above is to clean and passivate the piping of sprinkler systems by forming a foam of the corrosion inhibitor and passing it through the piping of the sprinkler system. For each sprinkler system to be treated it is first necessary to find out what the water qualities of the water flowing through the system are currently. If the system has been in place for some time and cleaning of the piping must be done, the installed pipe must be tested to see what types of corrosion are currently occurring and what, if any, types of microorganisms are growing in the system.

The water is tested using standard, known in the art water quality tests. Among the factors that are important to know are Cations; Na, K, Ca, Mg, Mn, dissolved Fe, Total Fe, Sr, and Ba.

Anions: Cl, Carbonate, Bicarbonate, Sulfate, Sulfide and Sulfite.

Other chemical properties tested for include: pH, total dissolved solids, total hardness, alkalinity, resistivity, dissolved oxygen, biological oxygen demand, chemical oxygen demand and any other relevant properties of the water.

Microbiological factors tested for include; sulfate reducing bacteria, iron related bacteria, acid producing bacteria, heterotrophic, slime producing bacteria. Test are performed with Biological Activity Reagent Test (BART) cultures, manufactured by Droycon Bioconcepts, Inc. Regina, Sask., Canada or other equivalent tests known in the art.

To test the corrosion in the pipes either a sample piece of pipe is removed or, if the system was provided with one, the corrosion coupon is removed and tested. Corrosion coupons are used to determine if corrosion is occurring within a system. A strip of the metal that the system is comprised of is weighed to $100^{th}$ of a milligram. The coupon is put into the system, usually through a threaded opening into the system, for a period of time (3 months to one year). The coupon is then extracted and weighed again to determine weight loss due to corrosion. The weight loss is reported as "mills/year" for standardization purposes.

Another major factor in the formation of the corrosion inhibitor to be used in any given system is the local environmental codes in force in a given location. The standards for what can be in the water of a given fire protection system can be affected by EPA codes, local water quality codes, fire codes, building codes and other related codes. These standards can be set by the Federal, state, county, city, fire protection district or any similar governing body with authority over the fire protection system or the water in the system. For any location, the operator must determine all codes that regulate the water content of fire protection systems and then ensure that the corrosion inhibitor to be applied does not violate any of the relevant codes. As there are so many possible codes and these codes change regularly, no attempt will be made to list the codes or the limiting conditions in this application. It is to be noted however, that if the fire protection system is to be operable and legal after treatment, this step must be done before the corrosion inhibitor is formulated.

Once the operator has tested the water, the pipes and determined the relevant codes a corrosion inhibitor can be chosen for the specific application. Code requirements may require variation from the preferred additives and combinations of additives not normally used. The following factors are taken into consideration upon specific formulation:

1. Local, state and Federal codes and regulations.
2. Professional trade organization recommendations.
3. Water and microbiological analysis to determine active MIC bacteria, nutrient availability, symbiotic colony formation possibilities, scale potential, biological oxygen demand and chemical oxygen demand for the MIC and chemical corrosion process.
4. Microscopic examination of the surface to be treated (internal pipe samples along with corrosion coupons) to determine if corrosive activity is conclusive of MIC or chemical corrosion (Guidelines provided by NACE "National Association of Corrosion Engineers).
5. Rate of corrosion established by corrosion coupons.

Specific formulations to resolve a specific problem must consider all of these factors and variables plus chemical and physical compatibility of the components. Therefore, groups of primary and secondary ingredients are listed for discrimination, in formulation, for that specific problem:

Gases: Air, carbon dioxide, nitrogen, and natural gas available from pipeline.
Primary Coating Components: X,Y,Z,and w
Bio-Static Coating Additives: C,V
High Temperature Coating Additives: J,I,S
High Velocity Coating Additives; H,O,and S
Oxygen Scavenger: I
Adjustment to pH: B,E
Electrolyte: A
Acid Foamer: Ab
Chelators & Sequesterants: D,F,J,L,M,and U
Scale Inhibitors-Crystal Distorters: T
Scale and Tubercle Removal: D, E, and J
Dispersal Surfactants: K,N, and Q)

Using well known chemical knowledge the formula can be determined from the components listed above within the formula disclosed above.

Once the formula for a specific system has been created, it is shipped to the job site to be applied to the sprinkler system. Referring first to FIG. 1, a foam generator 100 is attached to the sprinkler system to create the foam. The reservoir body 101 of foam generator 100 is made from stainless steel of varying grades and has a minimum pressure rating of about 150 psig. Above the reservoir, body 101 is a foam stabilizer 102. In the preferred embodiment, the foam stabilizer is a 2-inch ID stainless steel pipe, which is 12-inches in length in the preferred embodiment. The reservoir body 101 and foam stabilizer 102 can be one fabricated unit. Valves, fittings and accessories are stainless steel wherever possible.

The corrosion inhibitor disclosed above is stored in a tank 121 with a pump 107 attached to the body 101 via a stainless steel pipe 108. Pump 107 is controlled with a relay 111. The corrosion inhibitor is then injected into the base of the foam generator 100 through pipe 108 and allowed to fill to the desired level. A pump off sensor 112a is mounted in the body 101 at the fill line 113 to automatically shut off the pump 107 when the fluid level reaches the fill line 113 by sending a signal to the relay 111. A pump on sensor 112*b* can also be mounted in the body 101 at a lower level, automatically turning the pump 107 on before the fluid level lowers below the air sparger 106. The sensors 112 can be an electrode, infrared, ultrasonic or tuning fork sensor, or any other known fluid level sensor.

The foam generator 100 is designed to allow the operator to change corrosion inhibitor formulation "on the fly" or during the job without having to shut down if it is discovered that the formulation of the corrosion inhibitor is not having the desired result. All that needs to be done to change corrosion inhibitor is to fill tank 121 with the new formulation or to add new additives directly to the tank 100 via a valve provided for the purpose (not shown).

Compressed gas is supplied from a single or dual stage compressor 104 with a minimum performance of 10 scf at 125 psig or compressed gas cylinders, depending on the gas to be use. The compressor 104 may be portable or a stationary supply source depending on the application. The compressed gas is passed through an air regulator 105 and then through to an air sparger 106 mounted within the reservoir body 101 and located within the liquid level. Air sparger 106 (fine pore air diffuser) is made of porous silicon dioxide having uniform, finely sized pores, capable of producing fine, unified size (approximately 5 micron) gas bubbles from the compressed gas from compressor 104. The sparger 106 is similar in design to what is used to add air to aquariums for the hobbyist involved in raising tropical fish. In the preferred embodiment the air sparger 106 is from Aquatic Eco-Systems, Inc. Apopka, Fla. Part Number ALR 230 SS Sweetwater Diffuser; fine pore 9½" length ½" with a NPT stainless steel fitting. The corrosion inhibitor disclosed above has a good surfactant quality and therefore creates stable uniform foam 110 having a quality (Air Percent) of 50Q to 95Q and a half-life of at least one hour (as determined by American Petroleum Institute method "API 46" "Testing Foam Agents for Mist Drilling" ). The regulated gas pressure determines the quality, which is between 20 psig and 150 psig in a known manner.

The foam 110 rises to the foam stabilizer 102 where it becomes homogeneous in size and form and waits to be expelled into tubing 114, preferably 1 inch ID Tygon, by a solenoid valve 115, normally shut, powered by an interval timer 116. An airline connector 117 is provided next to the connection to the system to allow the piping system to be blown dry at the end of the treatment and to ensure that none of the corrosion inhibitor is left in the pipe. A system pressure relief valve 118 and bleed off valve 119 are provided to prevent over-pressurization of the system. A drain 120 is provided to allow the system to be emptied after use.

Figure 3:
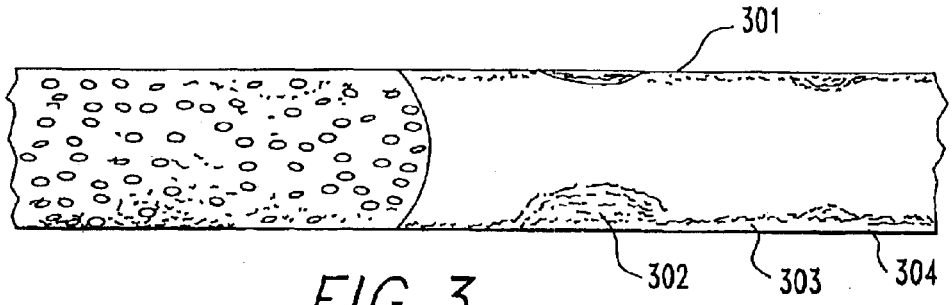
FIG. 3 is a cut away view of a pipeline during the first stage of the cleaning process.

The time of the valve-open and the time of the valve-shut for valve 115 may be independent values and set between tenths of a second to several minutes, depending on the application. This creates a pulsating affect as foam pressure is increased within the foam stabilizer 102 during the valve-shut stage. This pulsation creates foam segments that are energized with higher force and velocity for solids cleaning and displacement as shown in FIG. 3. The higher velocity also decreases bleeding and breakdown of the foam structure by reducing constant shear at the foam 110 to piping interface. It is to be understood that many other arrangements of the disclosed apparatus would function in the same way and no limitation is to be inferred.

Figure 2:
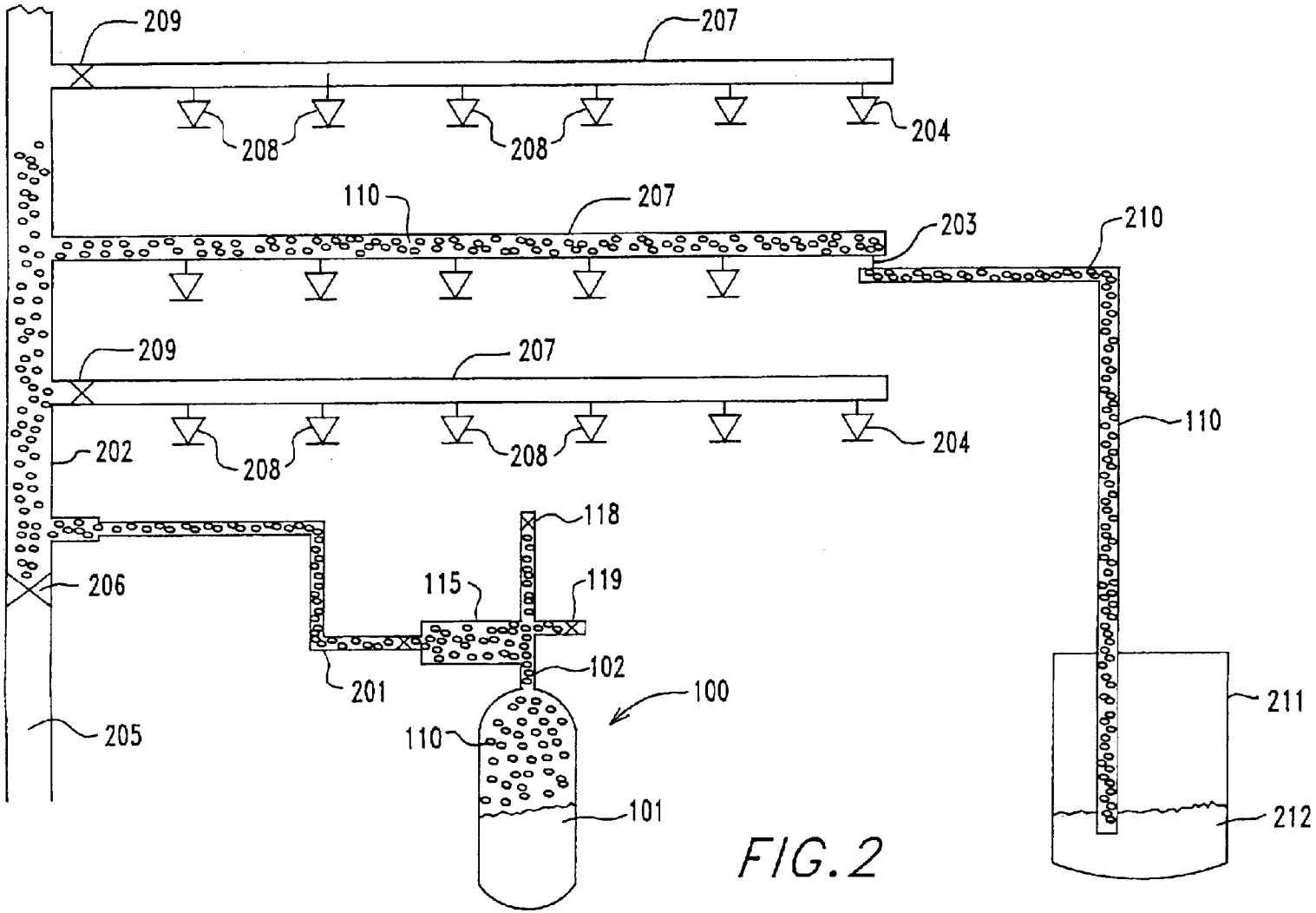
FIG. 2 is a cut away view of a fire protection system being treated with the present invention.

FIG. 2 shows the totality of a sprinkler system 200 being treated. In fire sprinkler systems one section of line is treated at one time. The foaming apparatus 100 is attached to the sprinkler system 200 with tubing 201 at the standpipe 202. In the preferred embodiment, clear Tygon tubing is used to make the connections. City main water pipe 205 is usually connected to the standpipe 202 to provide water to the sprinkler system 200. A backflow preventer 206 is placed at the start of the connection to the city main 205 to stop any contamination from entering the city main 205. The cross-mains 207 all come off of the stand pipe 202 and the pendent fire sprinklers 208 are attached at spaced intervals along the cross mains 207. Each cross-main 207 has an isolation valve 209 at the connecting point to the standpipe 202. To isolate the specific cross main to be treated, all other cross-main isolation valves are closed.

The foam 110 is extracted from the sprinkler system 200 at a quick connect fitting 203 located at the end of the line section being treated. This is usually where the last sprinkler head 204 is located. Drain tubing 210 is attached to the quick connect 203 and inserted into a container 211. The container 211 needs to be below the level of the sprinkler system cross-mains 207 to encourage drainage. In the preferred embodiment, the drain tubing 210 is Tygon tubing or other clear tubing which can withstand the contact with the corrosion inhibitor. An operator stationed at the container 211 is able to watch the exiting foam 110 in the clear drain tubing 210 and communicate to an operator of the apparatus 100 when the foam 110 is clear in nature and free of particles. The container 211 preferably has a sufficient amount of aqueous solution 212 in the bottom of the container 211 to encourage the formation of a siphon when the drain tubing 210 is inserted within the aqueous solution containing. The aqueous solution 212 contains a silicon defoamer to return the corrosion inhibitor to liquid form. In the preferred embodiment 10%, Dimethylpolysiloxane emulsion sold under the name SAG 1 and supplied by OSI Specialties, Inc. a division of Witco Corporation, Friendly, W.Va., USA. 0, is used) as the defoamer. Other known in the art defoamer could also be used.

FIG. 3 shows the initial foamed corrosion inhibitor 110 progressing down the piping 301 and loosening biomass 302, debris 303 and other particles created during the corrosion process such as iron oxides, iron sulfides, and existing slag. The surfactant ability of the foam 110 penetrates through the biomass 302 outer walls, breaking up the tubercle and removing corrosion by-products, exposing the piping surface 304 and suspending the corrosion by products in the foam. In the first stage, the corrosion inhibitor has a foam quality (Air Percent) of 50Q to 95Q. This stage may be repeated several times, using pulsed foam segments formed by the controller for valve 115 or continuous flow of foam 110 until the piping 301 is clean. As mentioned above an operator may monitor the drain tubing 210 in order to know when the system is clean and to move on to the second stage.

Figure 4:
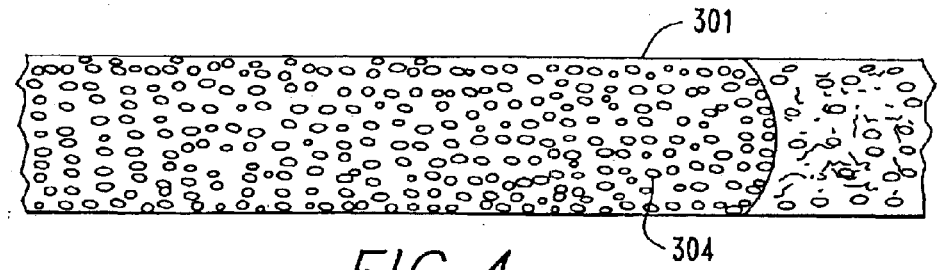
FIG. 4 is a cut away view of a pipeline during the second stage of the cleaning process.

FIG. 4 shows the second stage of the treatment consisting of a foamed, 50Q to 95Q corrosion inhibitor being exposed to the internal walls of the piping 304. The piping 301, being cleaned from previous stages, has an affinity for the corrosion inhibitor based foam 110 as discussed above. A thin layer of corrosion inhibitor coats the surface 304 of the piping 301 as the foam contacts the piping 301.

It is important that this stage be of sufficient duration to eliminate the possibility of "flash rusting" of the piping 301. The cleaning process has stripped ions and disrupted the oxygen layer of passivity from the piping 301, and created the possibility of localized galvanic corrosion. A total layer of passivity must be created to protect against renewed microbiological (MIC) and chemical corrosion. It is important to consider surface area increase by pitting within the piping 301. The length of time required for stage one cleanup shown in FIG. 3 is directly related to this increased surface area created by the corrosion process. Stage two, therefore, should be three times the length of total time of stage one to ensure a complete coating of the piping 201. The internal surface 304 of the piping 301 will be clean and the corrosion inhibitor, having a natural affinity for the metal surface, will plate out and form a micro-thin protective layer of passivity, which is impermeable to acid gases & microbes.

After the second stage of corrosion inhibitor foam, the section of line is blown dry with 100 psig compressed air at the rate of: (Length/25 ft)×line ID" =minutes of air injection. The starting time for this process is determined to begin right after the time for stage two has expired. The compressor 104 is attached to the airline connector 117 and the psig is altered as needed. The operator at the drain end can monitor the drain tube 210 to know when all the corrosion inhibitor is blown from the system 200.

The spent foam corrosion inhibitor is then shipped back to the original manufacturing plant (WHI USA, Inc., CO) for filtration, reconstitution of active chemical agents and usage as conventional corrosion inhibitor in applications where foaming is not desired, such as cooling tower and boiler protection. Recycling the corrosion inhibitor protects the environment and water resources from potential chemical contamination.

The recycling process begins when the foam exits the sprinkler system and is delivered through 1" Tygon tubing to the receiving vessel (55 gallon drum or 1,000-Liter Intermediate Bulk Container). An aqueous solution with 0.1% Silicone Antifoam Emulsion (10% Dimethylpolysiloxane emulsion) (Commercially available through Witco Corporation, 3500 South State Route 2, Friendly, W.Va. 26146 under the Trademark of SAG 10) covers the bottom 6 inches of the receiving vessel. The Tygon tubing is inserted below the liquid level in the vessel. As the spent foam, and particulates gathered in the cleaning process enters the mixture the entrapped gases coalesce and escape to atmosphere. Residual corrosion inhibitor and particulates gathered in the cleaning process are retained within the vessel. When the vessel becomes full, it is shipped to the manufacturer (WHI USA, Inc., Colo.) where it is removed from the vessel and filtered through a pressure filter (plate, rotary vacuum, or sock filter) to a particulate level below micron.

The filtrate is then filtered through a secondary filter (plate, rotary vacuum or sock filter) to a particulate level below 1 micron. The resulting product is practically particulate free at this point.

Laboratory analysis is then performed to determine quaternary amine ppm by: ASTM Test Method D5070–90 (1997) Standard Test Method for Synthetic Quaternary Ammonium Salts in Fabric Softeners by Potentiometric Titrations. Quaternary amine level for 100% active product is to be between 250,000–350,000 ppm, depending on the finished product desired. To reconstitute product to a finished product the following variables and constants are assigned for calculation:

C1=Batch Size (gallons)×Desired ppm quaternary amine

V0=Total Recycled quaternary amine volume in gallons

V1=Recycled quaternary amine (ppm)×gallons obtained

V2=Quaternary Amine needed for batch or

V2=C1−V1

V3={(quaternary amine concentrate) (activity percent) /gallon}

V4=Gallons of concentrate needed for batch or

V4=V2/V3 or (C1−V1)/V3

V5=other additives needed for batch

New Product Batch=V0+V4+V5

A new product is created by the above procedure, which is 100% functional and of high quality for use in cooling towers, boilers, and other industrial functions for corrosion control and pacification of exposed ferrous metals. The need to dispose of previously used product has been eliminated, removing potential environmental liability and any danger of contamination of the land, and various bodies of water.

Once the fire protection system has been cleaned and passivated, it is important to continue with regular maintenance of the system, to prevent the long-term disruption of the coating and renewed corrosion. The maintenance procedure for fire protection systems will depend on if the system is a dry system or a wet system. In a dry system, the water is not maintained in the pipes, although small amounts of water may remain in the system if it was not properly blown dry. In a wet system, water is held in the pipes at all times. The layer of passivity may be restored in a wet system by injecting an overage of the formulation within the water standing in the pipes. Dry systems may be maintained by flooding the system with water for the treatment and, after treatment, restoring to the functional dry state.

A small, prescribed, amount of the corrosion inhibitor is injected into the system with an overpressure apparatus described in detail below. The quaternary amine molecules rapidly replace any "hole" or space left vacant in the disrupted layer of pacification by ionic attraction and bonding. The formulation contains a true organic salt (quaternary amine salts) and follows the behavior of any ionic salt solution within an aqueous system. Osmotic pressure differentials exist at the point of injection. The entire ionic population is adjusted throughout the aqueous system by a process called ionic diffusion, or population uniformity of ions in a salt solution. As the ions move throughout the system to equalize the imbalance the cationic ions in solution bond to the oxide layer wherever disruption of the passive layer exist. This restores the layer of passivity within the internal piping wall.

The excess ionic presence in solution continues to protect the layer of passivity as long as the ionic overage exists in a wet system. Periodic maintenance treatments may have to be performed as the overage is decreased through operation of the individual system.

It has been determined (by actual field conditions) that a residual 20 ppm of quaternary ammonium salt within the aqueous-system provides more than adequate protection from disruption of the passive layer. Maintaining a 20-ppm residual offers continued protection against chemical and biological corrosion factors. The system may be tested, on a regular basis, to assure the overage of formulation is adequate. The 20-ppm level of quaternary ammonium salt is a safe exposure level for humans and is non-toxic to the environment.

Figure 5:
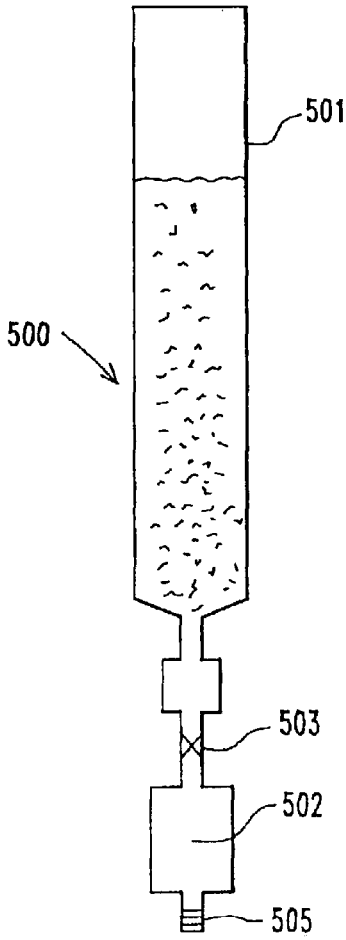
FIG. 5 is a schematic view of a device for dispersing the present invention into a pipeline or fire protection system.

The maintenance apparatus 500 shown in FIG. 5 is simple in design. It consists of a cylinder 501 rated for around 200 psig, a ball valve 502, a check valve 503 to prevent backflow into the cylinder 501 during operation, and an attachment mechanism 505 for attaching to the fire protection system. The cylinder 501 contains the desired amount of prescribed formulation, described below. Compressed gas is applied to the cylinder 501 to create an over pressure of 180 psig to provide the energy for injection into the fire protection system and to foam the corrosion inhibitor. The fire protection system is historically lower than 100 psig during operation.

Figure 6:
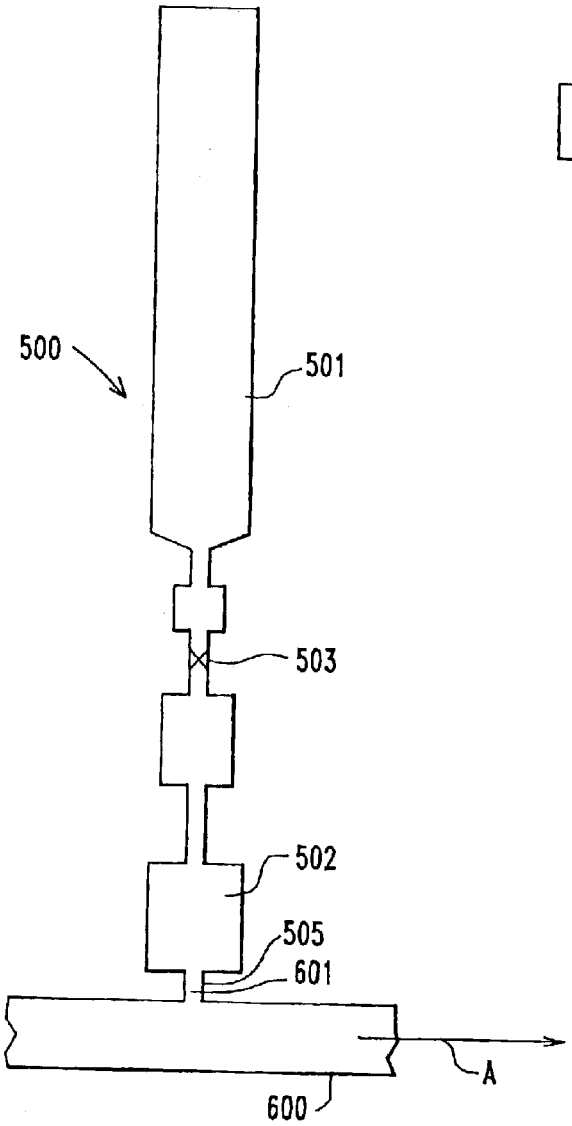
FIG. 6 is a schematic view of the device attached to a pipeline

As shown in FIG. 6, the cylinder 501 is then connected with the attachment mechanism 505 to the fire protection system at any point where access is allowed through an operational port. Opening the ball valve 502 then activates the cylinder 501. The over pressure in the cylinder 501 displaces the formulation into the fire protection system. Testing (by method described in above in the discussion of recycling and reconstituting) for quaternary amines is performed before and after maintenance treatment to prescribe dosage rates and determine effectiveness of maintenance treatment. Testing for MIC causing organisms and placement of corrosion coupons within the fire protection system is also required to determine effectiveness of maintenance treatment.

Example of chemical formulation needed within apparatus 500 to provide an addition 5 ppm in a 1,000 gallon fire protection system to bring the overall level of quaternary ammonium salt:

To provide an additional 5 ppm overage of quaternary ammonium salt within a 1,000 gallon fire protection system:

There is 3,785.4 milliliters in a US liquid gallon. Therefore, there is 3,784,500 mls in the fire protection system to be treated.

5 ppm/1,000,000 ppm=0.000005

0.000005×3,784,500=18.923 mls. Active formulation needed within cylinder.

Active concentration of quaternary ammonium salts within formulation=30.0%

The maintenance apparatus shown in FIG. 5 can also be used to inject the subject composition into an in-use pipeline to treat the pipeline without shutting down the pipeline. The dispersion of the composition with the high-pressure inert gas produces a dense foam, between 50Q to 95Q, which has sufficient body to form a "plug" of the material within a stream flowing through a pipeline into which it is injected. As describe above, the foam cleans and leave a corrosion resistant anti-microbial coating upon the pipe surface that it contacts.

As shown if FIG. 6, the apparatus 500 is attached to the pipeline 600 at valve 601. The ball valve 502 is then opened, injecting a plug of foam into the pipeline 600. The plug is carried downstream by the flow of material in the pipeline, shown by arrow A. Once the plug of foam is injected into the pipeline 600, the user monitors downstream to determine when the foam has been consumed by contact with the pipe using the test procedure noted above. At that point, a new injection is made to continue the cleaning and protecting of the pipeline 600. For most applications, a new plug of foam would be injected once the level of quaternary amines drops below 20 ppm. These steps of injecting and downstream monitoring are repeated as necessary until the length of the pipeline to be treated is complete.

Figure 7:
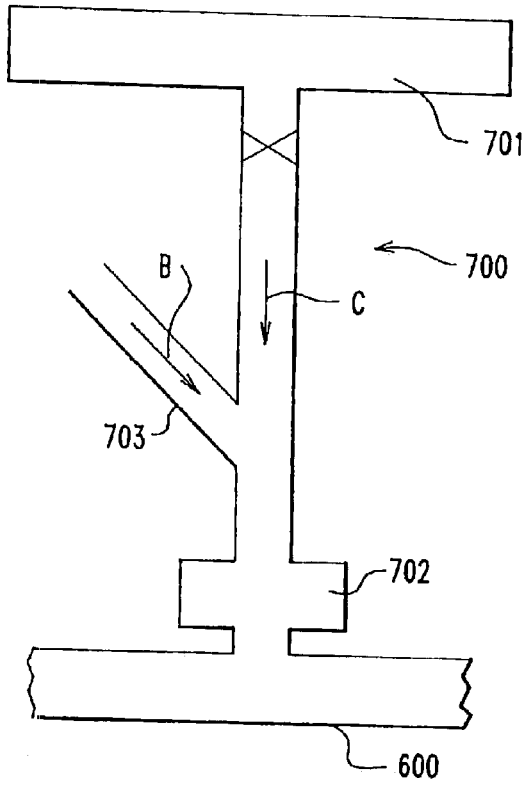
FIG. 7 is partial schematic illustration of a second device for dispersing foam in a pipeline.

FIG. 7 shows another embodiment, which may be used to replace apparatus 500 when a non-gas non-charged cylinder 701 is desired for any reason. Apparatus 700 is essentially identical to apparatus 500, except for the addition of the compressed gas port 703. The cylinder 701 is filled with liquid corrosion inhibitor and transported to the job site. The cylinder 701 is not pressurized before application of the corrosion inhibitor to the system to be treated. This increases the safety of transporting the cylinders 701. A compressed gas source is attached at 703 to supply a stream of compressed gas, shown by arrow B. The compressed gas foams the corrosion inhibitor as it flow out of the cylinder 701, shown by arrow C. Ball valve 702 controls the flow of foam into the pipeline 600. A non-pressurized cylinder 700 can be used anywhere compressed gas is available to attach to 703. This makes the cylinders 700 easier and safer to ship and safer for workman to carry to the job site.

A 12" natural gas pipeline has a normal operating pressure of 500 psig, therefore, it is not possible to treat using the pressurized cylinder 501 without first shutting the line down. Therefore, the gas pipeline would be shut off and the pressure bled off before any treatment. If a gas supply line (often called an instrument line) is available, the corrosion inhibitor may be added using that pressure through 703. This eliminates the need to carry pressurized cylinders 500 around in a vehicle and makes the cylinders easier and safer to ship.

Another method utilizing foam is to produce the foam in one end of a piece of pipe stock or an existing pipeline which is not in service, then push the foam through the pipe stock or pipeline using a compressed gas stream.

Preferred Parts and Chemical Suppliers:

DMCB 80 dimethylcocobenzyl quaternary amine,supplier: AKZO Chemicals, Chicago, Illinois). Tetra 12 quaternary amine supplier: Tetraco, Midland, Tex. D121(Cl) Di-C10 dimethyl ammonium chloride, supplier: Shanghai Jingwei Chemical Corporation, Singapore. Oleic Imidazoline supplier: Taiwan Surfactant Product Name: Ablumine-o. Tetra 45, supplier: Tetraco, Midland, Tex. Hydro Amine, supplier: B&D Chemical, Denver, Colo. Quaternized Alkyl Pyridine Tetra 600 supplier: Tetraco, Midland, Tex.). Tetra 610 Quaternized Alkyl Pyridine, supplier: Tetraco, Midland, Tex. Isotridecyloxpropyldihydroxyethylmethyl Ammonium Chloride, supplier: Tomah Product: Q-17-2-PG Van Waters & Rogers, Denver, Colo. Ammonium Chloride electrolyte, supplier, Van Waters & Rogers, Denver, Colo.).

Pump for corrosion inhibitor bases is commercially available from Cole-Parmer Instrument Company Vernon Hills, Ill., USA Part number U-75000-10 Flojet 115 Volt F Series Industrial Quad Pump model # F301010110. Dual point controller for "pump on" pump off" control is commercially available from Cole-Parmer Instrument Company Vernon Hills, Ill., USA part number U-43200-20 NEMA 4×local dual point controller, power 115 VAC/24 VDC. Optical electronic level control sensors, infrared, commercially available from ColeParmer Instrument Company Vernon Hills, Ill., USA, part number U-07186-75 Standard Sensors; applications mainly oil, water and mildly corrosive materials, PSF; max temp 200 F; Max psi 250; mounting fitting ½" NPT (M); conduit fitting ½" NPT (M). Hayward True Union solenoid valve for foam delivery instant on/off normally closed. Commercially available from Cole-Parmer Instrument Company Vernon Hills, Ill., USA Part number U-01346-00, 110 Volt, PVC, maximum pressure 150 psi, ½" NPT (F). Timer/Intervalometer, independent on/off control for Hayward True Union Solenoid Valve control. Parallel AC and logic level output. Timing capacity: 1 to 99 Minutes, 1 to 99 seconds, 0.1 to 9.9 seconds. Commercially available from Cole-Parmer Instrument Company Vernon Hills, Ill., USA Part number U-08683-90 115VAC, 50/60 HZ.

Although the present invention has been described with reference to preferred embodiments, numerous modifications and variations can be made and still the result will come within the scope of the invention. No limitation with respect to the specific embodiments disclosed herein is intended or should be inferred.

We claim:

1. A method of treating a sprinkler system comprising the steps of:

foaming a corrosion inhibitor into a foam with a 80 to 95 percent air; injecting the foam into the pipeline to be treated using about 100 psi;

cleaning the pipeline by flowing the foam through the pipeline until all debris have been removed;

coating the interior of pipeline with an antimicrobial, anti corrosion coating by flowing the foam continuously through the pipeline for approximately three times the length of time of the cleaning step; and drying the interior of the pipeline by blowing compressed air through the pipeline.

* * * * *